United States Patent [19]

Lines

[11] 4,206,691

[45] Jun. 10, 1980

[54] BOX FORMING APPARATUS

[75] Inventor: Dennis D. Lines, Sioux City, Iowa

[73] Assignee: Iowa Beef Processors, Inc., Dakota City, Nebr.

[21] Appl. No.: 902,195

[22] Filed: May 2, 1978

[51] Int. Cl.[2] ..... B31B 1/52

[52] U.S. Cl. ..... 93/49 R; 93/51 HW

[58] Field of Search ..... 93/51 HW, 49 R, 47; 53/381 R, 374

[56] References Cited

U.S. PATENT DOCUMENTS

| | | | |
|---|---|---|---|
| 3,478,653 | 11/1969 | Byrne | 93/51 HW |
| 3,645,067 | 2/1972 | Siegel | 53/374 X |
| 3,959,950 | 6/1976 | Fukuda | 93/49 R X |
| 4,022,116 | 5/1977 | Frappier | 93/51 HW X |
| 4,131,058 | 12/1978 | Graham | 93/49 R |

*Primary Examiner*—James F. Coan

*Attorney, Agent, or Firm*—Beveridge, DeGrandi, Kline & Lunsford

[57] ABSTRACT

Apparatus for bending sidewall-attached flaps of a box to positions where they lie interiorly of the box, substantially parallel and adjacent to their respective sidewalls. Opposed first and second flaps are contacted by first and second folder members which are moved arcuately in opposite directions from mutually adjacent retracted positions outside the box to extended positions in the box where they lie adjacent to the respective sidewalls.

15 Claims, 6 Drawing Figures

BOX FORMING APPARATUS

BACKGROUND AND SUMMARY OF THE INVENTION

This invention relates to apparatus used in the manufacture of boxes of the type having a rectangular base, vertical sidewalls perpendicular to the base, and flaps attached to the upper edges of opposed sidewalls, such flaps being bent to an interior position where they lie entirely within the box to provide the box with a multiple-thickness sidewall. Such boxes are customarily used in the packaging of boxed beef, as the interior flap provides a barrier to contaminants which might otherwise enter through the hand holes in the sidewalls. The flaps also serve a reinforcing function which is useful when a number of filled boxes are vertically stacked.

In the manufacture of boxes of this type, it has been customary prior to this invention to assemble the boxes with adhesive materials to complete the base and sidewall structure. It has also been customary to use a machine for bending the interior flaps to a horizontal position parallel to the base, this step being performed on the rear flap by a horizontally reciprocating plunger, and on the forward flap by a curved stationary guide rod which bends the forward flap as the box is moved into the guide rod by the plunger. This prior apparatus has then bent the flaps downwardly into the box to their final interior positions substantially parallel and adjacent to their respective sidewalls. The latter step has been performed by moving a frame downwardly into the box and then actuating four horizontal pneumatic cylinders on the frame to fold the four individual flap portions. This has been unduly complicated and has presented problems in coordinating the action of the cylinders.

The present invention is intended to provide an uncomplicated efficient apparatus for performing the final bending step during which the flaps are moved to their respective final positions lying inwardly of and substantially parallel to their respective sidewalls. This is performed by providing a first folder member supported for movement in an arcuate path extending from a retracted position outside the box to an extended position located inside the box adjacent one of the sidewalls, and a second folder member movable in an arcuate path extending from a retracted position outside the box to an extended position located in the box adjacent to the other sidewall. Actuating means are provided for moving the folder members from their retracted positions to their extended positions to move the respective flaps to their final positions inwardly of and substantially parallel to their respective sidewalls.

Each of the folder members is movable about a pivot axis located outside the box, this axis being displaced from the box in directions both parallel and perpendicular to the base of the box. The distance between these pivot axes is greater than the distance between the flap-contacting ends of the folder members when in their extended positions. Compressible cushioning materials on the folder members avert damage to the box material. Also preferred is the disclosed actuating means for moving the folder members, such actuating means having a single fluid operated cylinder-piston assembly and a pair of links, each link connecting one of the folder member assemblies to the cylinder-piston assembly whereby both folder members are moved equal distances in opposite directions.

The invention also pertains to apparatus in which the rear flap of the box is folded from an upstanding position to a position where it lies parallel to the base of the box. This apparatus includes a box pusher member movable in a forward direction against the box and provided with a forward projection which bends the rear flap. The forward projection has a forward portion which is upwardly and forwardly inclined, providing a forward edge spaced above the box sidewall in order to commence the folding action against the resistance of the box corrugations. The trailing portion of the projection is parallel to the path of the pusher to bend the rear flap to a position parallel to the base.

While the invention may assume a number of forms, a preferred version thereof is illustrated in the accompanying drawings and described in the following description thereof.

BRIEF DESCRIPTION OF A PREFERRED EMBODIMENT

Figure 1:
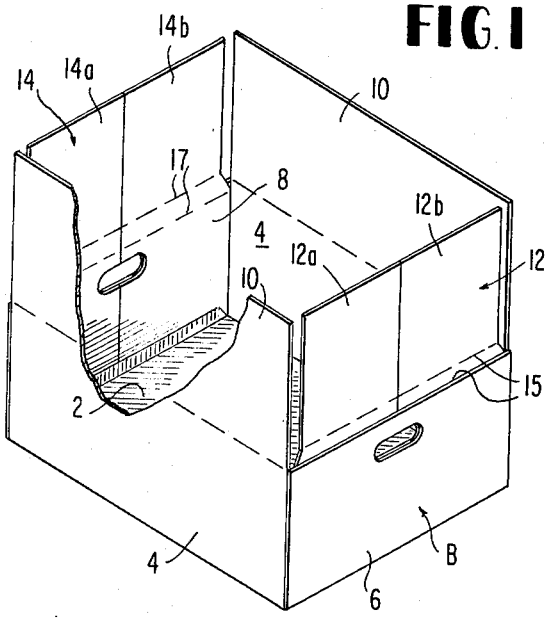
FIG. 1 shows a box of the type processed by the apparatus of this invention, at a stage when the box sidewalls are erected.
Figure 2:
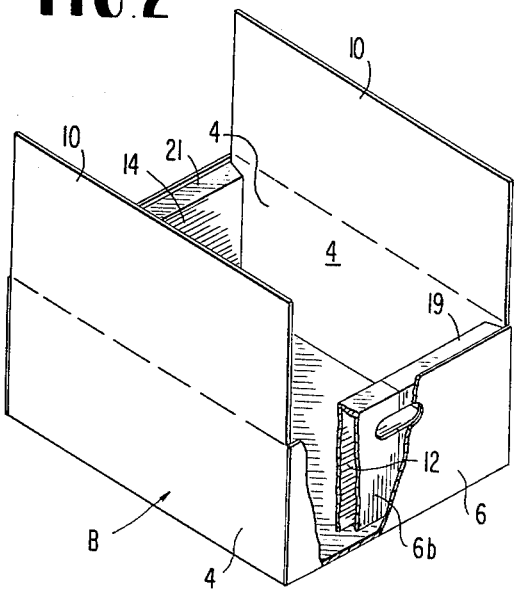
FIG. 2 shows the box of FIG. 1 in the configuration acquired after being processed by the apparatus of the invention.
Figure 3:
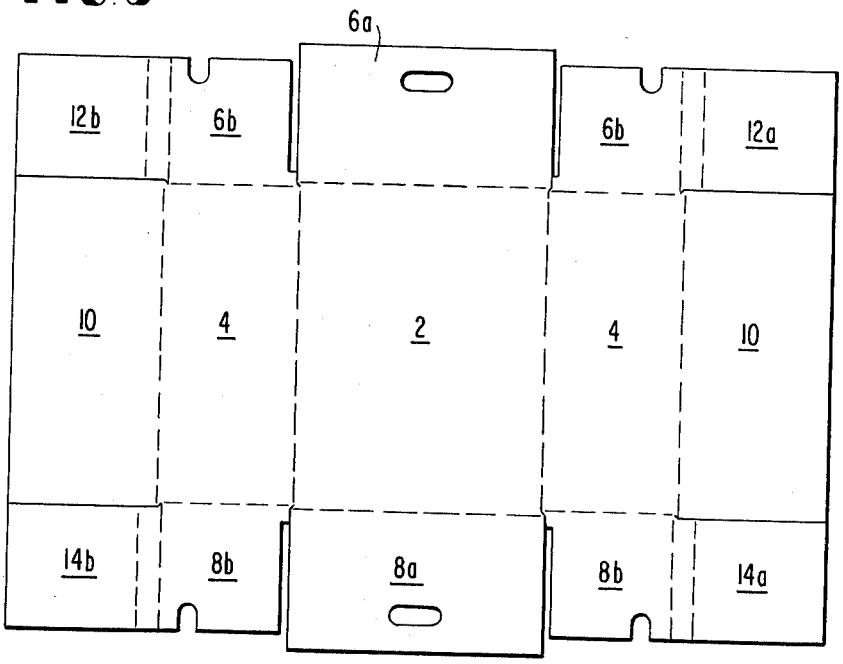
FIG. 3 shows a blank used for forming the box of FIGS. 1 and 2.

In order to understand the operation of the present invention, it is useful first to understand the construction of the box which is formed by the apparatus. As shown in FIG. 1, the box B has a rectangular base 2 and four upstanding sidewalls which are perpendicular to the base 2. The longitudinal sidewalls are indicated at 4, the forward sidewall at 6 and the rear sidewall at 8. Referring to FIG. 3, it will be seen that the forward sidewall 6 is formed by exterior end panel **6*a* adhesively bonded to the interior panels 6*b*. Similarly, the rear sidewall 8 includes a pair of panels 8*b* bonded to the interior surface of the end panel 8*a***.

Closure flaps 10 are attached to the upper edges of the sidewalls 4 for closing the box after it is filled. The forward wall 6 has a flap 12 formed of panels **12*a* and 12*b* attached to its upper edge; and, the rear sidewall 8 has a flap 14 attached to its upper edge, this flap 14 being comprised of the panels 14*a* and 14*b*. The flaps 12 and 14 are both provided with parallel bending lines of weakness 15 and 17 so that, when the box is completed the material between these lines will form the horizontal shoulders 21 and 22**.

Figure 6:
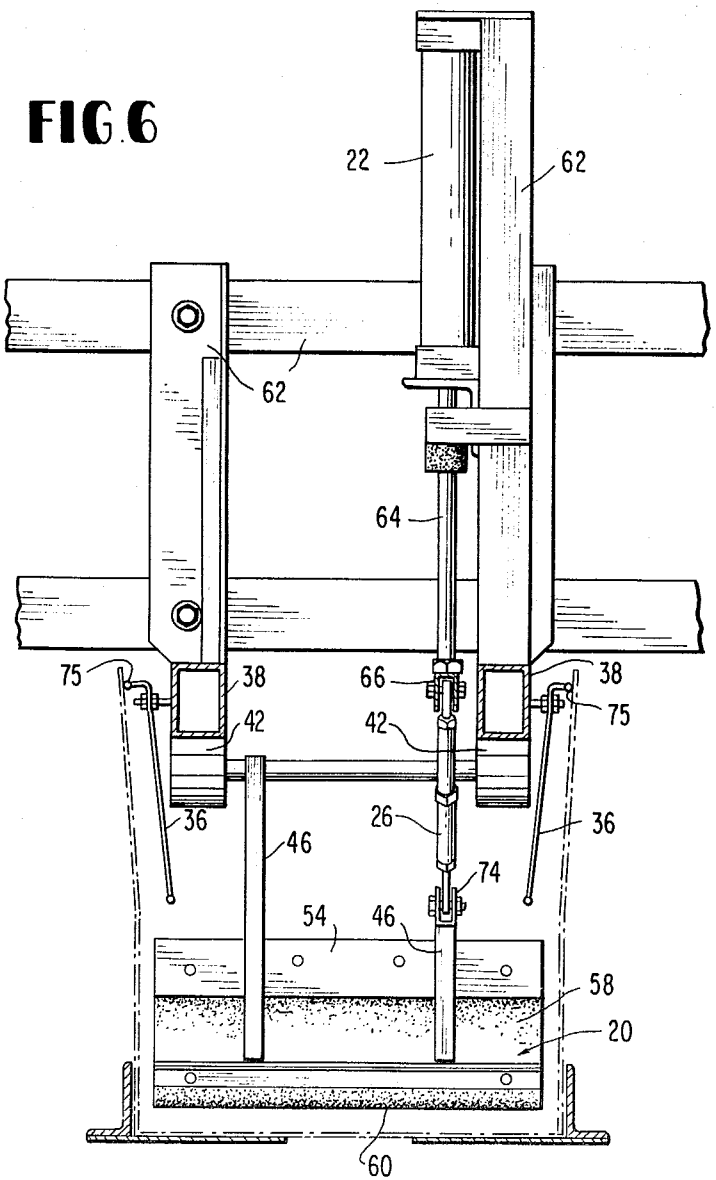
FIG. 6 is an end view of the apparatus of FIG. 5 looking in the direction opposed to the direction of box travel.

The purpose of the disclosed apparatus is to bend each of the flaps 12 and 14 from a vertical position to a horizontal position and then to the position shown in 'IG. 2 where it lies inwardly adjacent of and substan-ally parallel to its respective sidewall. The preferred pparatus is illustrated in FIGS. 4–6.

Figure 4:
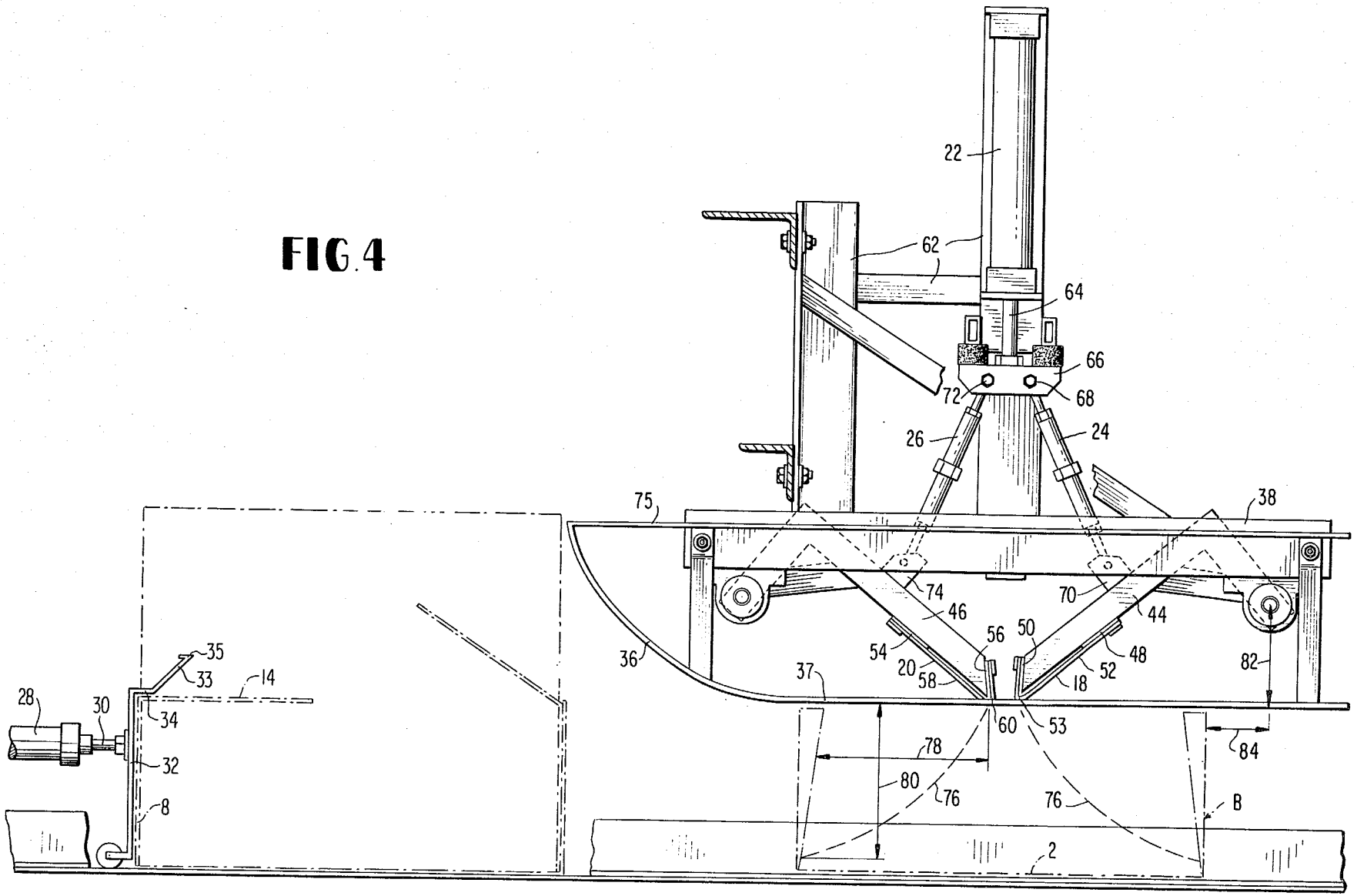
FIG. 4 is a side elevational view of the apparatus of the invention, showing the box feeding mechanism and the flap folding mechanism with the folder members in their retracted positions.
Figure 5:
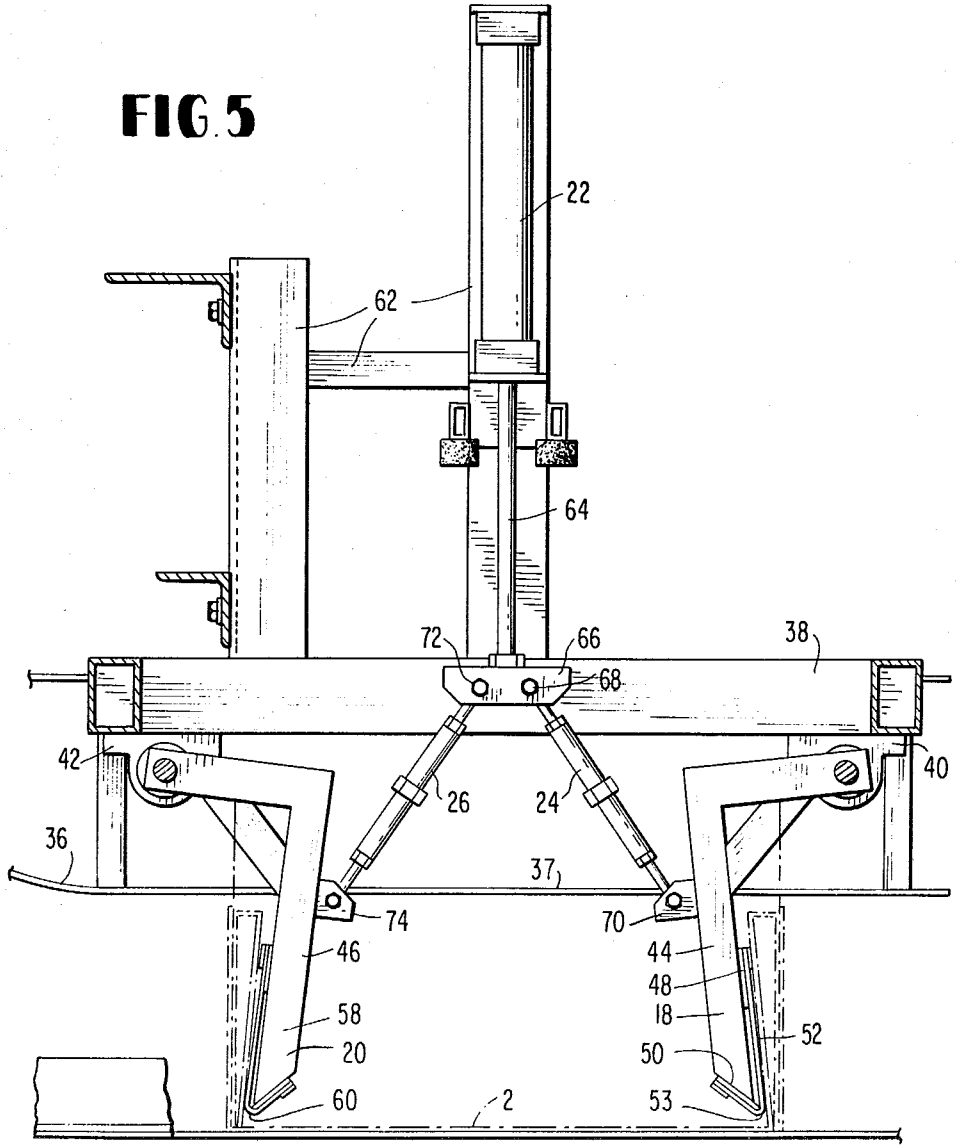
FIG. 5 shows the flap folding mechanism of the invention with the flap folder members in their extended positions, the folding of the interior flaps having been completed.

FIG. 4 shows in solid lines a box having its flaps 12 nd 14 preliminarily bent to a horizontal position. The ox is located at a work station on the support surface 6, centrally beneath the folder members 18 and 20. The ɔlder members are actuated by a single fluid operated ylinder-piston assembly acting through links 24 and 26. 'he folder members 18 and 20 are thus moved to the xtended positions illustrated in FIG. 5, moving the aps 12 and 14 to their final positions inwardly of and ıbstantially parallel to their respective sidewalls.

The mechanism for feeding the boxes to the work tation and for initially bending the flaps 12 and 14 from ıeir positions parallel to the sidewalls 6 and 8 to their ositions perpendicular to the sidewalls is shown in 'IG. 4. This mechanism was previously known except ɔr the specific structure of its forward projection. A ylinder-piston assembly 28 has a plunger rod 30 at-ıched to a pusher member 32 which carries a forward rojection formed of a leading portion 33 and a trailing ortion 34. The leading portion is inclined forwardly nd upwardly to provide a leading edge 35 which ıakes initial contact with the rear flap 14 at a point ɔaced above the sidewall 8. The trailing portion 34, /hich moves the rear flap to a position substantially arallel to the box base, lies substantially parallel to the ath of rod 30 and pusher 32. Extension of the rod 30 rings the leading edge 35 against the rear flap 14 to ommence the forward bending movement. The trail-ıg portion 34 continues the bending until the rear flap rrives at the horizontal position perpendicular to side-/all 8. Continued movement of rod 30 brings pusher ıember 32 against the wall 8 to drive the box for-/ardly. This forward movement brings the forward ox flap 12 against the curved rods 36 which, during ox movement, bend the forward flap 12 from its posi-on parallel to the sidewall 6 to a horizontal position ıbstantially perpendicular to the sidewall 6. Upon ɔmpletion of the extension stroke of rod 30, the box B /ill be at the position shown in solid lines in FIG. 4, the aps 12 and 14 being held in their horizontal positions y the horizontal portions 37 of the rods 36.

At the work station, there is a frame 38 suitably sup-orted above the box-supporting surface 16. The frame 8 has sets of pillow blocks 40 and 42 which pivotally ıpport axles carried by the L-shaped support arms 44 ıd 46 for the respective flap folder members 18 and 20.

The flap folder member 18 includes a pair of elon-ated rectangular plates 48 and 50 with an overlying ıeet 52 of rubber belting material which serves as a ɔmpressible cushion to minimize damage to the box ıaterial when struck by the flap folder member 18. IG. 6 shows the transverse dimensions of the elements f the flap folder member 18 to be slightly less than the 'ansverse dimensions of the box interior. The acute ıgle at the lower end of the folder member 18 provides ı edge 53 for initially contacting the flap 12.

The flap folder member 20 is constructed similarly to ıe member 18, having a pair of plates 54 and 56 cov-:ed by a rubber belting material 58 to provide a lower uter end 60 of the folder member 20, this outer end ɜing substantially parallel to the base and to the front ıd rear sidewalls of the box B at the work station.

The actuation of the folder members 18 and 20 is roduced by the fluid operated cylinder-piston assem-ly 22 which is also supported on the frame 38 by the members 62. The assembly 22 has a vertically movable rod 64 which carries a yoke 66 at its lower end. A pivot 68 connects the yoke 66 to the upper end of an adjust-able link 24, the lower end of link 24 being connected to a bracket 70 on the arm 44 of folder member 18.

The upper end of link 26 is pivotally connected at 72 to the yoke 66. The lower end of link 26 is pivotally connected to a bracket 74 on the arm 46 of the rear flap folder member 20. The respective lengths of the links 24 and 26 are adjustable in a known manner to permit initial adjustment of the machine to the optimum condi-tions.

When the cylinder-piston assembly 22 is actuated to drive rod 64 downwardly, the yoke 66 causes down-ward movement of the links 24 and 26, swinging the arms 44 and 46 equidistally in opposite directions about their respective bearings 40 and 42. This causes the folder members 18 and 20 to move in arcuate paths which extend from the retracted positions shown in FIG. 4 located outside the box to extended positions shown in FIG. 5, located within the box adjacent to the respective sidewalls 6 and 8. The simultaneous equidis-tant movement of the folder members exerts opposed equal forces on the box, performing a self-centering function which enables the apparatus to be constructed without any box-retaining means.

Movement of the folder members 18 and 20 bends the flaps slightly beyond the vertical to the position shown in FIG. 5. The flaps may spring back slightly, but they tend to remain in position due to frictional engagement between the three edges of the flap and the interior surfaces of the box.

The paths of the folder members 18 and 20 within the box are arcuate as indicated by the broken lines 76. The centers of rotation of the paths, coincident with the axes of bearings 40 and 42, are spaced apart by a distance greater than the distance between the ends 53 and 60 when extended as shown in FIG. 5. These centers of rotation are displaced from the box in directions both parallel and perpendicular to the base of the box. The arcuate paths are preferably disposed to minimize rela-tive movement between the flaps and the flap-contact-ing portions of the flap folders. For boxes having the proportions illustrated, the arcuate paths 76 have a component 78 parallel to the base which is greater than their component 80 perpendicular to the base of the box B. The displacement of the pivot axes from their associ-ated sidewalls is greater in a direction perpendicular to the base indicated by the dimension 82 than in a direc-tion parallel to the base as represented by the dimension 84.

In the normal operation of the apparatus, a box with all flaps in their vertical positions is positioned to the left of the work station as illustrated in FIG. 4. Cylinder 28 is actuated to move the angle 32 against the rear of the box, the horizontal part of angle 32 moving the rear flap 8 from its vertical position to a horizontal position. The vertical portion of the angle 32 drives the box forwardly so that the vertical forward flap 12 strikes the downwardly-curved rod 36 until the flap 12 is in its horizontal position parallel to the base of the box. A horizontal portion 37 of the rod 36 overlies the work station to hold flaps 12 and 14 in their horizontal posi-tions when the apparatus is in the position illustrated in FIG. 4.

When the box arrives at the work station as shown in FIG. 4, rods 75 hold the side flaps 10 clear of the folder mechanism. The folder members 18 and 20 are located centrally above the guided box in the illustrated retracted position. The cylinder 22 is actuated to move downwardly the rod 64, yoke 66 and links 24 and 26. The links 24 and 26 move the arms 44 and 46 of the folder members 18 and 20 pivotally about their respective pivot axes, causing the tips 53 and 60 of the folder members to contact the flaps 12 and 14 and move through equal oppositely-directed arcs. The box itself does not move since it is subjected to equal opposed forces. The flaps 12 and 14 are bent to the positions shown in FIG. 5 where the vertical faces of the folder members are substantially parallel to the flaps.

After arriving at the position shown in FIGS. 5 and 6, the cylinder 22 is returned to the initial position shown in FIG. 4, removing the folder members 18 and 20 from the box and permitting the box to be discharged from the apparatus in an appropriate direction.

This specification has described only one possible embodiment of the invention. Persons familiar with the mechanical arts will realize that the objectives of this invention may be performed by various structures which differ in form but not in substance from this embodiment. Therefore, it is emphasized that the invention is not limited solely to the disclosed embodiment but is encompassing of other structures within the spirit of the following claims.

I claim:

1. An apparatus for moving the flaps of a box which has a rectangular base, sidewalls extending perpendicularly from the base, and first and second flaps connected to the upper edges of opposed first and second sidewalls, each of said flaps being bendable to a final position lying inwardly of and substantially parallel to its respective sidewall, said apparatus comprising, means for supporting a said box at a work station, means for bending said flaps to their final positions including a first folder member for contacting said first flap, a second folder member for contacting said second flap, and actuating means for said folder members, means for supporting the first folder member for movement in an arcuate path which extends from a retracted position outside the box to an extended position located in said box adjacent said first sidewall, means for supporting said second folder member for movement in an arcuate path which extends from a retracted position outside the box to an extended position located in said box adjacent said second sidewall, said actuating means including means for moving each of said folder members from its retracted position to its extended position to move the respective said flap to its final position, means for moving the box to said work station, means for initially bending the flaps inwardly from positions parallel to their respective sidewalls to positions perpendicular to their respective sidewalls prior to arrival of the box at said work station, and means at said work station for holding said flaps at their initially bent positions prior to movement of said folder members from their retracted positions to their extended positions.

2. The apparatus of claim 1 wherein said folder members have outer ends which are adjacent to each other when in their retracted positions and lie substantially parallel to said rectangular base and said first and second sidewalls, the distance between said members when in their extended positions being less than the distance between the centers of rotation of said arcuate paths.

3. The apparatus of claim 1 wherein said folder members have outer ends which are adjacent to each other when in their retracted positions and lie substantially parallel to said rectangular base and said first and second sidewalls, the distance between said members when in their extended positions being less than the distance between the centers of rotation of said arcuate paths, said actuating means including a fluid-operated cylinder-piston assembly, and link means connecting each of said folder members to said cylinder-piston assembly.

4. The apparatus of claim 1 in which the retracted position of said first folder member is adjacent to the retracted position of said second folder member, pivot means supporting said first folder member, pivot means supporting said second folder member, said pivot means being spaced apart by a distance greater than the distance between said members in their extended positions.

5. The apparatus of claim 1 wherein said first folder member has an outer end which in the retracted position is substantially parallel to both said rectangular base and said first sidewall of a box at said work station, and said second folder member has an outer end which in the retracted position is substantially parallel to both said rectangular base and said second sidewall of a box at said work station.

6. The apparatus of claim 4 in which said first folder member is mounted for pivotal movement about an axis which is displaced from said box in directions parallel and perpendicular to said rectangular base, and said second folder member is mounted for pivotal movement about an axis which is displaced from said box in directions parallel and perpendicular to said rectangular base.

7. The apparatus of claim 1 in which said first folder member is mounted for pivotal movement about an axis which is displaced from said box in directions parallel and perpendicular to said rectangular base, and said second folder member is mounted for pivotal movement about an axis which is displaced from said box in directions parallel and perpendicular to said rectangular base.

8. The apparatus of claim 1 wherein the means for moving said folder members from their retracted positions to their extended positions is a single means.

9. The apparatus of claim 8 in which said single means is a fluid-operated cylinder-piston assembly, and link means connecting each of said folder members to said cylinder-piston assembly.

10. The apparatus of claim 6 wherein said first folder member has an outer end which is substantially parallel to both said rectangular base and said first sidewall of a box at said work station, and said second folder member has an outer end which is substantially parallel to both said rectangular base and said second sidewall of a box at said work station.

11. The apparatus of claim 10 wherein the means for moving the box includes a pusher member for engaging the rear sidewall, actuator means for moving the pusher member toward the work station, said means for initially bending the flaps including a forward projection supported on said pusher member at an elevation above said sidewalls.

12. The apparatus of claim 11 wherein the forward projection includes a leading portion which is inclined upwardly and forwardly, and a trailing portion which adjacent to said pusher member is substantially parallel to the path of said pusher member.

13. An apparatus for moving the flaps of a box which has a rectangular base, sidewalls including front and rear sidewalls extending perpendicularly from the base, and upstanding front and rear flaps connected to the upper edges of said front and rear sidewalls, means for moving the box including a pusher member for engaging said rear sidewall, actuator means for moving the pusher member against the box to move the box forwardly in a direction parallel to said base, flap bending means rigidly affixed to said pusher member, said flap bending means including a projection permanently extending forwardly from the pusher member at a fixed orientation and at an elevation above the rear sidewall and in alignment with said upstanding rear flap, said projection having a leading edge positioned to make initial contact with said upstanding rear flap at a point spaced above said rear sidewall to commence the forward bending movement of the rear flap when moved thereagainst by the actuator means, said projection having a surface for bending said rear flap to a position substantially parallel to said base.

14. The apparatus of claim 13 having stationary obstruction means located forwardly of the box at an elevation above said front sidewall and in alignment with the upstanding front flap, whereby movement of the box by the pusher member causes the upstanding front flap to be folded downwardly.

15. The apparatus of claim 14 having folding means which includes front and rear folder members for folding the front and rear flaps into the box to lie adjacent to their respective sidewalls, said folder members being supported for movement in arcuate paths which extend from retracted positions outside said box where their flap-contacting portions are adjacent to each other to extended positions where their flap-contacting portions lie within the box adjacent to their respective front and rear sidewalls.

* * * * *